United States Patent [19]

Reilly

[11] 4,102,297

[45] Jul. 25, 1978

[54] ACOUSTICAL SIGNAL APPARATUS

[75] Inventor: Francis X. Reilly, Lyndhurst, N.J.

[73] Assignee: Leslie Co., Parsippany, N.J.

[21] Appl. No.: 787,972

[22] Filed: Apr. 15, 1977

[51] Int. Cl.[2] ..... G10K 9/04

[52] U.S. Cl. ..... 116/142 FP

[58] Field of Search ..... 116/142 FP, 142 R, 137 R

[56] References Cited

U.S. PATENT DOCUMENTS

| | | | |
|---|---|---|---|
| 1,690,177 | 11/1928 | Peterson | 116/142 FP |
| 1,994,426 | 3/1935 | Billig | 116/137 R |
| 2,177,594 | 10/1939 | Eaves | 116/142 FP |
| 3,581,705 | 6/1971 | Holm | 116/142 FP |
| 3,670,689 | 6/1972 | Pappas | 116/142 FP X |
| 3,942,468 | 3/1976 | Olofsson | 116/142 FP |

*Primary Examiner*—Daniel M. Yasich

*Attorney, Agent, or Firm*—Lerner, David, Littenberg & Samuel

[57] ABSTRACT

An improved air horn is provided which includes a housing having an inlet for receiving a pressure medium to operate the horn and an outlet for the pressure medium. A first chamber is disposed between the inlet and outlet and receives the pressure medium from the inlet. A conventional sound-emitting horn is connected to the housing for receiving the pressure medium from the outlet, with the horn having a predetermined frequency. A closed resonating tube is connected to the other side of the housing, and a diaphragm is disposed between the first chamber and the resonating tube for oscillating movement in response to pressure changes in the first chamber and the resonating tube. A relatively small diaphragm having a natural frequency higher than the horn frequency is selected, as it is more economical and requires less energy to vibrate it. The resonating tube is selected to have a frequency which acts as a dampening effect on the diaphragm to prevent the diaphragm from vibrating at its natural frequency so that it is forced to vibrate at the desired horn frequency.

9 Claims, 4 Drawing Figures

ACOUSTICAL SIGNAL APPARATUS

FIELD OF THE INVENTION

The present invention relates generally to acoustical signal apparatus, such as air horns, and specifically to an improved air horn having a resonating tube which acts to dampen the diaphragm and prevent it from vibrating at its own natural frequency, so that the diaphragm will vibrate at the horn frequency.

BACKGROUND OF THE INVENTION

Presently-known signal apparatus or air horns include a vibrating diaphragm which acts as a valve to introduce pulsations in a fluid stream to cause an air column in the horn to vibrate at a defined frequency which is a function of the shape and dimensions of the horn. For best results, the oscillations of the diaphragm should correspond to the frequency of the horn. In the past, to accomplish this, it has been common to change the diameter of the diaphragm for different horns, so that the diaphragm's natural frequency corresponds to the horn frequency.

However, more recently, it has been found that by the use of complex diaphragm arrangements, including various damping mechanisms disclosed in U.S. Pat. Nos. 2,579,784, and 3,117,552, that a single diameter diaphragm can be made to operate satisfactorily with a fairly wide range of horn frequencies. Such diaphragm arrangements thereby avoided the need of changing the diaphragm for each horn having a different frequency. In such single diameter diaphragms, the basic frequency of the horn is substantially lower than the natural frequency of the diaphragm, and the diaphragm is forced to vibrate at the frequency of the horn. However, in some cases, the horn has a frequency at the higher end of the range of horn frequencies, and the difference between the horn frequency and the natural frequency of the diaphragm is relatively small. In such cases, there is a tendency for the diaphragm to want to vibrate at its own natural frequency, which is undesirable, since the diaphragm's natural frequency is different from the horn frequency which is desired.

Accordingly, it would therefore be desirable to provide an arrangement which ensures that the diaphragm will vibrate at the horn frequency, and not its own natural frequency. It is also desirable to provide a diaphragm arrangement for such signal apparatus which is simple and inexpensive to construct.

Broadly, it is an object of the present invention to provide an improved signal apparatus which overcomes one or more of the aforesaid problems. Specifically, it is within the contemplation of the present invention to provide an improved signal apparatus which utilizes a single diameter diaphragm for a relatively wide range of horn frequencies, without employing complex diaphragm arrangements.

It is a further object of the present invention to provide an improved signal apparatus which ensures that the diaphragm will vibrate at the desired horn frequency, rather than its own natural frequency, even when the difference between the horn frequency and the diaphragm frequency is relatively small.

It is a still further object of the present invention to provide an improved signal apparatus which employs a diaphragm arrangement of simple construction, which is economical to manufacture and efficient in its operation.

SUMMARY OF THE INVENTION

Briefly, in accordance with the principles of the present invention, an improved signal apparatus is provided which includes a housing having an inlet for receiving a pressure medium, such as compressed air, to operate the apparatus and having an outlet for the pressure medium. A first chamber is disposed between the inlet and the oulet for receiving the pressure medium from the inlet. A conventional sound-emitting horn is connected to the housing for receiving the pressure medium from the housing outlet, with the horn having a predetermined frequency. In addition, a closed resonating tube is connected to the housing on the side of the housing opposite to that of the horn. A diaphragm is disposed between the first chamber and the resonating tube for oscillating movement in response to pressure changes in the first chamber and the resonating tube, and the diaphragm operates to control the flow of the pressure medium from the first chamber to the outlet and to the horn. A diaphragm is selected which is small in size and which is economical, even though it has a natural frequency which is not matched to the horn frequency, and in most cases, the natural frequency of the diaphragm is substantially higher than the horn frequency. In order to ensure that the diaphragm vibrates at the horn frequency, rather than at the natural frequency of the diaphragm, the resonating tube is selected to have a relatively high frequency, which acts as a dampening effect on the diaphragm to prevent it from vibrating at its own natural frequency, so that the diaphragm is forced to vibrate at the frequency of the horn, the desired result.

Another way of stating the relationship between the resonating tube and the horn is that the resonating tube is selected to have a minimum wavelength relationship to the highest horn frequency with which the selected diaphragm operates.

Advantageously, as a result of the present invention, a smaller and more economical diaphragm may be employed in the signal apparatus, and as a result of its smaller size, the diaphragm requires less energy to vibrate it and is therefore more efficient. In addition, the selected diaphragm operates satisfactorily with a relatively wide range of horn frequencies, without employing complex diaphragm arrangements, as in the prior art. Finally, as a result of employing the resonating tube of the present invention, it ensures that the diaphragm will vibrate at the frequency of the horn, rather than at the natural frequency of the diaphragm, which is higher than the desired horn frequency.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DISCUSSION OF THE PREFERRED EMBODIMENTS OF THE INVENTION

Figure 1:
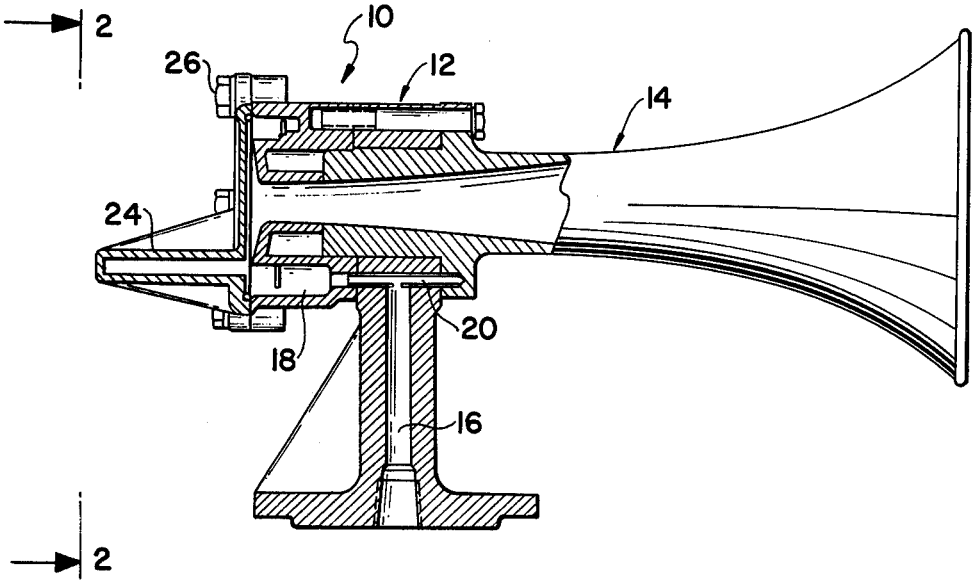
FIG. 1 is a side elevational view of a signal apparatus employing the principles of the present invention, partially broken away to show the housing in cross-section.
Figure 2:
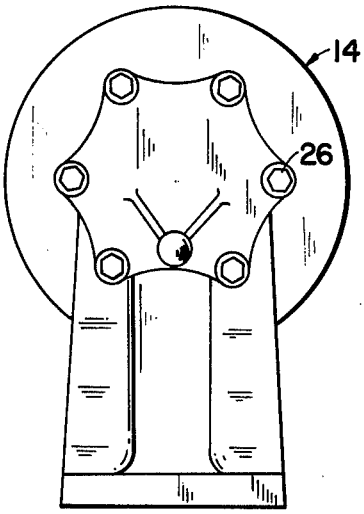
FIG. 2 is an end elevational view of the signal apparatus.

Referring now to FIG. 1, there is shown an improved acoustical signal apparatus embodying the principles of the present invention, generally designated by the reference numeral 10. The apparatus includes a housing 12 on which is mounted a conventional sound-emitting horn 14. The housing 12 includes an inlet 16 for a pressure medium, such as compressed air or steam, with the inlet 16 leading to an annular chamber 18 via a passageway 20. For a reason to be explained, the passageway 20 is narrower than annular chamber 18, such that the passageway 20 supplies the pressure medium to chamber 18 at a slower rate than which the pressure medium leaves annular chamber 18. The housing 12 further includes an axially-extending chamber or outlet 22 connected to sound-emitting horn 14 to form a continuous funnel therewith.

A closed resonating tube 24 is connected to the other side of housing 12 in a conventional manner, such as by bolts 26. A diaphragm 30 is mounted for oscillating movement in housing 12 and oscillates in response to pressure changes in chambers 18 and 22 and resonator 24. Diaphragm 30 is provided with an opening **30*a* formed therein to allow passage of the pressure medium from annular chamber 22 to another chamber 28 disposed on the other side of diaphragm 30 and to resonator 24**.

As will be explained, as diaphragm 30 moves away from the face **12*a* of housing 12, diaphragm 30 defines a passagewy 32 between the diaphragm and the face 12*a*. The passageway 32 connects annular chamber 18 and chamber 22. In this manner, movement of diaphragm 30 controls the flow of the pressure medium from annular chamber 18 to chamber 22 and to horn 14**.

The movement of diaphragm 30 produces pulsations in the fluid stream in horn 14 and causes the air column therein to vibrate at the frequency of the horn 14. In fact, in most cases, the basic frequency of the horn is substantially lower than the natural frequency of diaphragm 30, and the diaphragm 30 is forced to vibrate at the horn frequency, rather than at the natural frequency of the diaphragm. However, at the higher horn frequencies, the difference between the basic frequency of the horn and the natural frequency of the diaphragm decreases, and there is an occasional tendency for the diaphragm to vibrate at its own natural frequency, rather than the desired horn frequency. As a result of the present invention, the diaphragm is forced to vibrate at the horn frequency, rather than the diaphragm's natural frequency, even when the margin of difference between the horn frequency and the diaphragm frequency is small. The operation of the apparatus of the present invention will be described as follows.

In operation, the pressure medium, such as compressed air, is supplied through inlet 16 via passageway 20 to annular chamber 18. The pressure in chamber 18 continues to build until it is sufficient to deflect diaphragm 30 to the left. As a result, passageway 32 between chamber 18 and chamber 22 is opened, and it allows the air pressure in chamber 18 to release into chamber 22 via the passageway 32. This causes the pressure in chamber 18 to decrease, while the pressure in chamber 22 increases. Simultaneously, air pressures passes through diaphragm opening **30*a* and causes a pressure buildup in chamber 28 and resonator 24. However, the pressure buildup in chamber 22 occurs faster than the pressure buildup in chamber 28 and resonator 24 due to the restriction of opening 30*a*. Accordingly, diaphragm 30 continues to be biased to the left. Substantially simultaneously, the air pressure in chamber 22 produces an air wave to move to the right along horn 14. As a result, the pressure in chamber 22 starts to decrease, while the pressure in chamber 28 continues to increase. At this point, the air wave is moving to the right in horn 14 and further decreases the pressure on the right side of diaphragm 30. As a result, the increased pressure in chamber 28 operates to force diaphragm 30 toward the right and back into engagement with face 12*a* of housing 12. When this occurs, air pressure begins to leak back from chamber 28 into chamber 22 to decrease the pressure in chamber 28, and as passageway 32 is closed off, the pressure supply within chamber 18 also begins to rebuild. At this point, the air wave in horn 14 returns to the left toward diaphragm 30 and operates to build up pressure in chamber 22 and in conjunction with the buildup of pressure in chamber 18 to again force diaphragm 30 to the left and reopen passageway 32**. The above-described cycle then repeats itself.

It should be understood that diaphragm 30 is vibrating at the horn frequency which may be in the range of 250 to 550 cycles per second. Accordingly, the above-described operation of the movement of diaphragm 30 to the left and right, and the attendant pressure changes in chambers 18, 22, and 28, are occurring substantially simultaneously and many times per second. Therefore, the sequence of operation which has been described is merely a theory of operation, and it is not intended that the present invention be limited thereby.

As described above, there is a tendency for diaphragm 30 to vibrate at its own natural frequency, rather than the horn frequency, especially at the higher horn frequencies, where the difference between the natural frequency of the diaphragm and the horn frequency is relatively small. To overcome this tendency of the diaphragm to vibrate at its own natural frequency, resonating tube 24 and chamber 28 operate to provide a dampening or tuning effect on the vibration of diaphragm 30 to prevent it from vibrating at its natural frequency and to force it to vibrate at the horn frequency. The dampening effect of resonating tube 24 on diaphragm 30 is to prevent the diaphragm from increasing its rate of vibration and to thereby eliminate its tendency to vibrate at its higher natural frequency. That is, the dampening effect of resonating tube 24 prevents the frequency of diaphragm 30 from increasing and "jumping" from the desired horn frequency to the natural frequency of the diaphragm.

Figure 3:
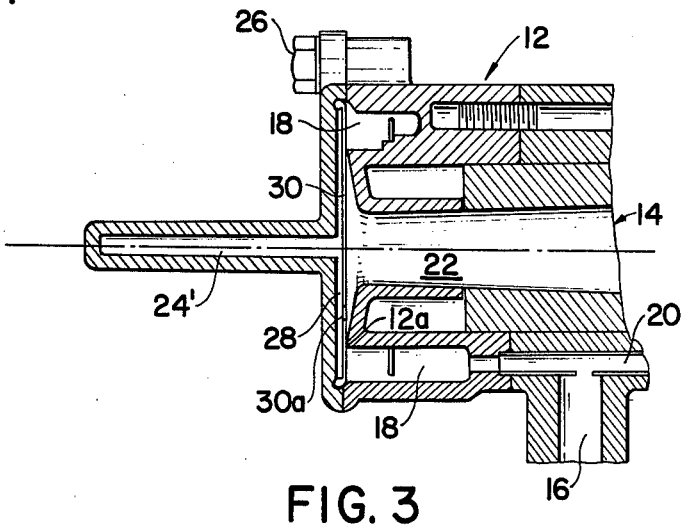
FIG. 3 is a cross-sectional view of a modified embodiment of the signal apparatus employing the principles of the present invention.
Figure 4:
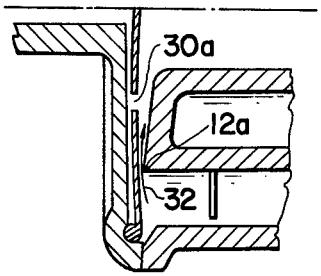
FIG. 4 is a cross-sectional view, in detail, of a portion of the apparatus shown in FIG. 3.

Referring now to FIGS. 3 and 4, there is shown a modified form of the acoustical signal apparatus embodying the principles of the present invention. This embodiment is similar to the embodiment of FIG. 1 in all respects, except that resonating tube 24' is in axial alignment with horn 14, rather than being offset relative to horn 14 as is resonating tube 24.

In view of the foregoing, it should be clear that as a result of the present invention, smaller-size and less complex diaphragm arrangements, which are more economical, may be employed in the acoustical signal apparatus of the present invention. Although such smaller-size diaphragms have a higher natural frequency than the horn frequency, the tendency for such diaphragms to vibrate at such higher natural frequency is overcome and prevented by the dampening effect of the resonating tube disposed on the side of the diaphragm opposite to that of the horn. As explained above, since smaller-size diaphragms may be employed, the signal apparatus of the present invention is less expensive to construct and is also more efficient in its operation, since it requires less energy to drive and vibrate the smaller-size diaphragms.

A latitude of modification, change, and substitution is intended in the foregoing disclosure, and in some instances, some features of the invention will be employed without a correspoding use of other features. Accordingly, it is appropriate that the appended claims be construed broadly and in a manner consistent with the spirit and scope of the invention herein.

What is claimed is:

1. An acoustical signal apparatus, comprising:

a housing having an inlet for receiving a pressure medium to operate the apparatus and having an outlet for the pressure medium;

a first chamber connected to said inlet and said outlet for receiving said pressure medium from said inlet;

a sound-emitting horn connected to said housing for receiving said pressure medium from said outlet and having a predetermined horn frequency;

an elongated resonating chamber having one end in continuous fluid communication with said housing and the other end continuously closed;

a diaphragm connected to said housing between said first chamber and said resonating chamber for oscillating movement in response to pressure changes in said first chamber and said resonating chamber, said diaphragm including means for controlling the flow of said pressure medium from said first chamber to said outlet and to said horn, said diaphragm having a natural frequency higher than said horn frequency;

said resonating chamber selected to be of a size such that when filled with said pressure medium, it has a characteristic frequency which has a tuning effect on said diaphragm to prevent said diaphragm from vibrating at its natural frequency so that said diaphragm is forced to vibrate at said horn frequency.

2. The apparatus of claim 1 wherein the flow controlling means of said diaphragm includes an opening formed therein to allow passage of said pressure medium between said first chamber and said resonating chamber.

3. The apparatus of claim 1 wherein said first chamber is an annular chamber surrounding said outlet.

4. The signal apparatus of claim 1 further including a passageway between said first chamber and said outlet, said passageway being open upon movement of said diaphragm in the direction of said resonating chamber.

5. The apparatus of claim 4 wherein said passageway is larger than said inlet so that the pressure medium within said first chamber leaves said first chamber through said passageway at a faster rate than which it is supplied to said first chamber via said inlet.

6. The apparatus of claim 1 wherein said resonating chamber is selected such that it has a minimum wavelength relationship to the highest horn frequency with which said diaphragm operates.

7. The apparatus of claim 1 wherein said resonating chamber and said horn are concentrically arranged about the same longitudinal axis.

8. The apparatus of claim 1 wherein said resonating chamber and said horn are offset relative to each other.

9. The apparatus of claim 1 wherein the flow controlling means of said diaphragm include an opening between said outlet and said resonating chamber to allow the passage of said pressure medium between said resonating chamber and said horn.

* * * * *

UNITED STATES PATENT AND TRADEMARK OFFICE

CERTIFICATE OF CORRECTION

PATENT NO. : 4,102,297

DATED : July 25, 1978

INVENTOR(S) : FRANCIS X. REILLY

It is certified that error appears in the above-identified patent and that said Letters Patent are hereby corrected as shown below:

Column 1, Line 27, after "2,579,784," insert: -- 2,789,529 -- .

Signed and Sealed this

*Sixth* Day of *February 1979*

[SEAL]

*Attest:*

RUTH C. MASON
*Attesting Officer*

DONALD W. BANNER
*Commissioner of Patents and Trademarks*